US006434949B2

(12) United States Patent
Botzler et al.

(10) Patent No.: US 6,434,949 B2
(45) Date of Patent: Aug. 20, 2002

(54) METHOD AND TREATMENT DEVICE FOR THE COOLING OF HIGHLY HEATED METAL COMPONENTS

(75) Inventors: Peter Botzler, Langebrück; Carsten Deus, Dresden; Lutz Wolkers, Berlin, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/822,016

(22) Filed: Mar. 30, 2001

Related U.S. Application Data

(63) Continuation of application No. PCT/DE99/03237, filed on Sep. 30, 1999.

(30) Foreign Application Priority Data

Sep. 30, 1998 (DE) ..... 198 45 805

(51) Int. Cl.[7] ..... F25D 25/00

(52) U.S. Cl. ..... 62/62; 62/65; 164/627; 415/115

(58) Field of Search ..... 62/62, 65; 148/627; 415/115

(56) References Cited

U.S. PATENT DOCUMENTS 5,173,124 A * 12/1992 Baxter et al. ..... 148/633
5,226,982 A * 7/1993 Eylon ..... 148/522
5,568,833 A * 10/1996 Frasier ..... 164/128
5,624,231 A * 4/1997 Ohtomo et al. ..... 415/115
5,921,310 A * 7/1999 Kats et al. ..... 164/61

FOREIGN PATENT DOCUMENTS

| | | |
|---|---|---|
| DE | 1 274 151 | 8/1968 |
| DE | 34 05 244 C1 | 4/1985 |
| DE | 28 39 807 C2 | 4/1986 |
| DE | 42 08 485 C1 | 2/1993 |
| EP | 0 119 186 A2 | 9/1984 |
| EP | 0 129 701 A1 | 1/1985 |
| FR | 576.695 | 8/1924 |

* cited by examiner

*Primary Examiner*—Ronald Capossela
(74) *Attorney, Agent, or Firm*—Herbert L. Lerner; Laurence A. Greenberg; Werner H. Stemer

(57) ABSTRACT

A method for cooling metal components highly heated in a chamber includes effecting a uniform cooling of an entire metal component. The metal component has regions each with a given mass, some of the regions having a larger mass than others of the regions. Housings are provided around regions with the relatively larger masses. The regions are subjected to the inert cooling gas in a controlled manner to a differing extent based upon the mass size. The housings are individually subjected separately with the inert cooling gas. A treatment device for cooling metal components includes a reservoir for holding inert cooling gas and a chamber for receiving a metal component to be cooled. The chamber is connected to the reservoir and has a housing for each of the regions with the larger mass. Each of the housing has an inlet orifice separately connected to the reservoir.

7 Claims, 1 Drawing Sheet

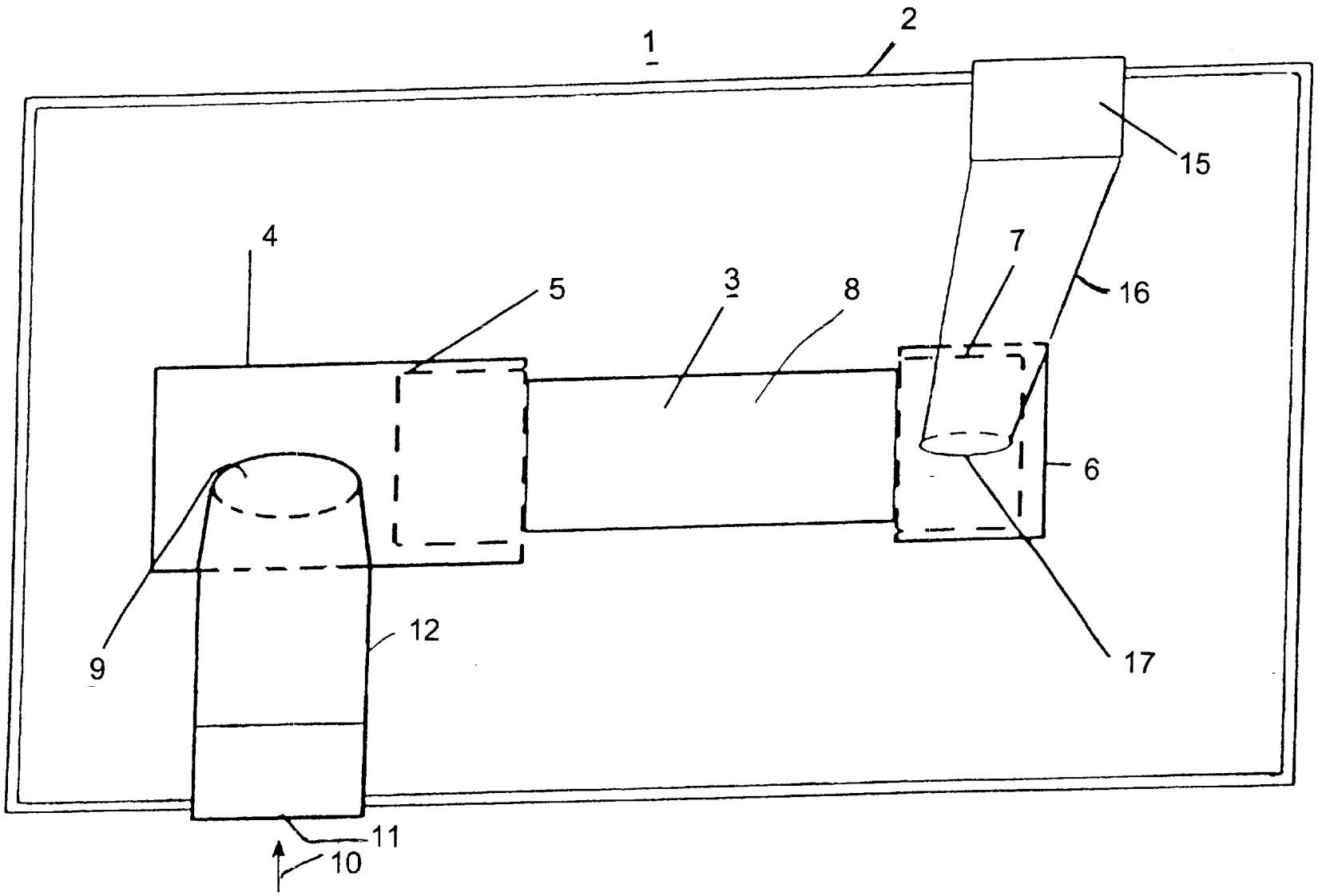
1
2
3
4
5
6
7
8
9
10
11
12
15
16
17

METHOD AND TREATMENT DEVICE FOR THE COOLING OF HIGHLY HEATED METAL COMPONENTS

CROSS-REFERENCE TO RELATED APPLICATION

This application is a continuation of copending International Application No. PCT/DE99/03237, filed Sep. 30, 1999, which designated the United States.

BACKGROUND OF THE INVENTION

Field of the Invention

In a course of the production of metal components, in particular, of metal components subjected to high mechanical and thermal load, preliminary process heating is often necessary, so that the metal components can subsequently be provided, for example, with a coating. The heating of the metal components and the coating of these are carried over, as a rule, in a closed-off chamber, often in a vacuum chamber. After the treatment of the metal components, they have to be cooled, for which purpose it is appropriate simply to open the chamber and, thus, expose the metal components to the ambient temperature. As a result, however, an uncontrolled thermal shock is exerted on the metal components, and, because of the shock, it seems advisable to cool the components in the chamber with an inert cooling gas, often referred to as a quenching gas, by flooding the chamber with the inert cooling gas.

SUMMARY OF THE INVENTION

It is accordingly an object of the invention to provide a method and treatment device for the cooling of highly heated metal components that overcomes the hereinaforementioned disadvantages of the heretofore-known devices and methods of this general type and that achieves a uniform cooling of the entire metal component regardless of the configuration of the metal components.

With the foregoing and other objects in view, there is provided, in accordance with the invention, a method for cooling metal components highly heated in a chamber, including effecting a uniform cooling of an entire metal component, the metal component having regions each with a given mass, some of the regions having a larger mass than others of the regions, by providing housings around the regions with the relatively larger mass, and subjecting the regions to an inert cooling gas in a controlled manner to a differing extent based upon a size of each given mass, and individually subjecting each of the housings separately with the inert cooling gas.

To achieve its objectives, the invention provides a method for the cooling of metal components highly heated in a chamber, in which an inert cooling gas is introduced into the chamber having the highly heated metal components, and regions of the metal components are subjected in a controlled manner to the inert cooling gas to a differing extent according to the size of their mass such that a uniform cooling of the entire metal component takes place.

The term "metal components" refers not only to straightforward metal components, but also to coated metal components, such as, for example, ceramic metal components.

An essential advantage of the method according to the invention is that, due to the controlled supply of inert cooling gas to the regions of the metal components according to mass concentration, a reduction of thermal stresses in the respective metal component is achieved during the cooling operation. Consequently, even components having a highly complex configuration with a widely varying mass distribution can be cooled relatively quickly, with avoidance of thermal stresses. As a result, a better utilization of treatment devices required for carrying out the method is also achieved. A further advantage is that, due to the controlled cooling of individual regions, overall, a uniform cooling of the entire metal component takes place. As a result, the method according to the invention can be integrated effectively and in a simple way into a comprehensive method that, for example, involves further heat treatment.

In carrying out the method according to the invention, the individual regions of the metal components to be treated can be subjected to the inert cooling gas to a differing extent in different ways. For example, it is possible, by more or fewer gas supply nozzles for the inert cooling gas to be mounted in a controlled manner in the vicinity of the individual regions of the metal components, and to subject these regions to the cooling gas to a differing extent. It is considered particularly advantageous, however, if the regions of the metal components with relatively large mass are provided with housings and the housings of regions with different mass are each individually subjected separately to the inert cooling gas. To be precise, such housings can be produced at relatively little outlay, particularly when they are used at the same time for holding the metal components in the chamber.

By the method according to the invention, metal components of widely varying configuration and different mass distribution can be cooled. In the case of metal components that are gas turbine blades, advantageously, the foot plate and head plate of the gas turbine blades are provided with housings, because these parts have a relatively large mass, as compared with the turbine blade leaf lying therebetween.

In accordance with a further mode of the invention, the method according to the invention affords the advantageous possibility of subjecting the metal components individually to the inert cooling gas on inner faces. Such application is additionally conducive to a uniform cooling of the component.

Furthermore, the invention proposes a treatment device for the cooling of metal components. The device has a chamber for receiving the metal components. The treatment device achieves uniform cooling of the metal components at relatively low outlay in terms of construction and manufacture.

With the objects of the invention in view, there is also provided a treatment device for cooling metal components, including a reservoir for holding an inert cooling gas, a chamber for receiving at least one metal component to be cooled, the metal component having regions each with a given mass, some of the regions having a larger mass than others of the regions, the chamber fluidically connected to the reservoir, the chamber having a housing for each of the regions with the larger mass, and each of the housing having at least one inlet orifice separately connected to the reservoir.

An essential advantage of the treatment device according to the invention is that the device can be manufactured in a relatively simple way because devices with a chamber that, as a rule, are already present, are merely to be provided additionally with housings for the metal components with connections of their inlet orifices.

In accordance with a concomitant feature of the invention, it is considered particularly advantageous if gas supply regulating devices are disposed between the reservoir and each of the at least one inlet orifice.

Other features that are considered as characteristic for the invention are set forth in the appended claims.

Although the invention is illustrated and described herein as embodied in a method and treatment device for the cooling of highly heated metal components, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

The FIGURE is a diagrammatic elevational view of a treatment device according to the invention.

DESCRIPTION OF THE PREFERRED EMBODIMENTS

Referring now to the single FIGURE of the drawing, it is seen that a treatment device 1 has a chamber 2, preferably a vacuum chamber, in which a metal component 3 has been highly heated, for example, heated to 1100° C. to carry out coating. Additional devices, not illustrated for the sake of greater clarity, heat the component 3.

For cooling the metal component 3, the component 3 is surrounded, for example, by non-illustrated manipulators with a housing 4 on one region 5 and with a further housing 6 on a further region 7. If the component 3 is, for example, a gas turbine blade, the region 5 forms the foot and the region 7 the head plate of the turbine blade. In the case of a gas turbine blade, the leaf 8 extends between the foot 5 and the head plate 7. Both the region 5 or foot of a gas turbine blade and the region 7 or head plate of a gas turbine blade have relatively large masses, as compared to the region 8 or leaf lying between them, and are, therefore, provided with the housings 4 and 6.

The housing 4 is filled through an inlet orifice 9 with an inert cooling gas that flows in the direction of the arrow 10 into the housing 4 through a gas supply regulating device 11 and a pipe 12.

Through a further gas supply regulating device 15, a pipe 16, and an inlet orifice 17 in the housing 6, the housing 6 is likewise filled with the inert cooling gas that, as in the case of the housing 4, can flow out into the interior of the chamber 2 through non-illustrated gaps at the edge of the further housing 6.

A non-illustrated, regulated, gas suction-extraction device can regulate the throughput of inert cooling gas through the chamber 2.

Because, in the treatment device 1 illustrated, each housing 4, 6 can be subjected individually to the cooling gas through a gas supply regulating device 11, 15, it is possible to subject each housing 4 or 6 separately to inert cooling gas to the extent required to achieve uniform cooling in light of the masses of the regions 5, 7 of the metal component 3 that are surrounded by the housings 4 and 6. If the cooling of the region 8 of the metal component 3 brought about by the inert gas in the chamber 2 is additionally taken into consideration, then it is possible, by an appropriate actuation of the gas supply regulating devices 11, 15, to ensure that the metal component 3, overall, is cooled uniformly.

We claim:

1. A method for cooling metal components highly heated in a chamber, which comprises:

effecting a uniform cooling of an entire metal component, the metal component having regions each with a given mass, some of the regions having a larger mass than others of the regions, by:

providing housings around the regions with the relatively larger mass; and subjecting the regions to an inert cooling gas in a controlled manner based upon a size of each given mass, and individually subjecting each of the housings separately with the inert cooling gas.

2. The method according to claim 1, wherein the metal component is a gas turbine blade having a foot plate and a head plate, and the providing step is carried out by providing housings around the foot plate and the head plate.

3. The method according to claim 1, wherein the metal component has inner faces, and which further comprises subjecting the metal component individually to the inert cooling gas on the inner faces.

4. A method for cooling a gas turbine blade highly heated in a chamber, the gas turbine blade having a foot plate, a leaf, and a head plate each with a given mass, the mass of the foot plate and the head plate greater than a mass of the leaf, the method which comprises:

effecting a uniform cooling of an entire gas turbine blade, by:

providing housings around the foot plate and the head plate; and subjecting the foot plate, the leaf, and the head plate to an inert cooling gas in a controlled manner based upon a respective size of each given mass, and individually subjecting each of the housings separately with the inert cooling gas.

5. A treatment device for cooling metal components, comprising:

a reservoir for holding an inert cooling gas;

a chamber for receiving at least one metal component to be cooled, the metal component having regions each with a given mass, some of the regions having a larger mass than others of the regions;

said chamber fluidically connected to said reservoir;

said chamber having a housing for each of the regions with the larger mass; and each of said housing having at least one inlet orifice separately connected to said reservoir.

6. The treatment device according to claim 4, including gas supply regulating devices disposed between said reservoir and each of said at least one inlet orifice.

7. A treatment device for cooling a gas turbine blade having a foot plate, a leaf, and a head plate each with a given mass, the mass of the foot plate and the head plate greater than a mass of the leaf, the treatment device comprising:

a reservoir for holding an inert cooling gas;

a chamber for receiving a gas turbine blade to be cooled;

said chamber fluidically connected to said reservoir;

said chamber having a housing for each of the foot plate and the head plate; and each of said housing having an inlet orifice separately connected to said reservoir.

* * * * *